US006361411B1

(12) United States Patent
Chopra et al.

(10) Patent No.: US 6,361,411 B1
(45) Date of Patent: Mar. 26, 2002

(54) METHOD FOR CONDITIONING POLISHING SURFACE

(75) Inventors: Dinesh Chopra, Boise; Scott E. Moore, Meridian, both of ID (US)

(73) Assignee: Micron Technology, Inc., Boise, ID (US)

( * ) Notice: Subject to any disclaimer, the term of this patent is extended or adjusted under 35 U.S.C. 154(b) by 0 days.

(21) Appl. No.: 09/494,548

(22) Filed: Jan. 31, 2000

Related U.S. Application Data

(62) Division of application No. 09/336,759, filed on Jun. 21, 1999, now Pat. No. 6,196,899.

(51) Int. Cl.[7] ..... B24B 1/00

(52) U.S. Cl. ..... 451/56; 451/66; 451/285; 451/287; 451/443; 451/5; 451/9

(58) Field of Search ..... 451/56, 59, 72, 451/66, 63, 264, 285, 287, 288, 290, 443, 5, 9, 11, 21

(56) References Cited

U.S. PATENT DOCUMENTS

| | | | | |
|---|---|---|---|---|
| 4,052,243 A | | 10/1977 | Yazawa et al. | |
| 5,053,827 A | * | 10/1991 | Tompkins et al. | 355/271 |
| 5,216,843 A | * | 6/1993 | Breivogel et al. | 51/131.1 |
| 5,486,131 A | | 1/1996 | Cesna et al. | |

(List continued on next page.)

FOREIGN PATENT DOCUMENTS

| | | | |
|---|---|---|---|
| EP | 9630778.5 | | 5/1997 |
| JP | 05057606 A | * | 3/1993 |
| JP | 10029157 A | * | 2/1998 |
| JP | 10233421 A | * | 9/1998 |

OTHER PUBLICATIONS

World intellectual Property Organization (WO 01/1586 A1) Mar. 8, 2001.*

Patent application Publication to Chopra et al, US 2001/0006881, Jul. 5, 2001.*

*Primary Examiner*—Peter Vo
*Assistant Examiner*—Minh Trinh
(74) *Attorney, Agent, or Firm*—Dickstein Shapiro Morin & Oshinsky LLP

(57) ABSTRACT

A chemical-mechanical polishing apparatus is provided with a downstream device for conditioning a web-shaped polishing pad. The device may be used to condition a glazed portion of the pad, and then the conditioned pad portion may be used again for polishing. The conditioning device is preferably arranged to apply different conditioning treatments to different portions of the glazed pad. The conditioning device may have roller segments that rotate at different speeds. Alternatively, the device may have non-cylindrical rollers that provide different rotational speeds at the pad surface, or the device may apply different pressures at different portions of the pad. The device may be arranged to provide uniform conditioning across the width of the pad. The invention is applicable to methods of planarizing semiconductor wafers. The invention may be used to condition circular pads in addition to web-shaped pads. The conditioning device may be adjusted or controlled in response to surface characteristics data obtained by measuring polished wafers.

7 Claims, 6 Drawing Sheets

U.S. PATENT DOCUMENTS 5,527,424 A 6/1996 Mullins
5,611,943 A 3/1997 Cadien et al.
5,643,044 A 7/1997 Lund
5,655,951 A 8/1997 Meikle et al.
5,664,987 A 9/1997 Renteln
5,692,947 A 12/1997 Talieh et al.
5,707,492 A 1/1998 Stager et al.
5,759,089 A 6/1998 McCoy
5,775,983 A 7/1998 Shendon et al.
5,779,526 A 7/1998 Gill
5,785,585 A 7/1998 Manfredi et al.
5,830,043 A 11/1998 Aaron et al.
5,860,853 A 1/1999 Hasegawa et al.
5,872,633 A * 2/1999 Holzapfel et al. ..... 356/381
5,885,147 A * 3/1999 Kreager et al. ..... 451/443
5,934,974 A 8/1999 Tzeng
5,961,372 A 10/1999 Shendon
5,969,521 A * 10/1999 Kurita et al. ..... 324/229
5,975,944 A * 11/1999 Sandhu et al. ..... 451/56
5,980,368 A 11/1999 Chang et al.
5,997,384 A 12/1999 Blalock
6,039,633 A 3/2000 Chopra
6,120,349 A * 9/2000 Nyui et al. ..... 451/21
6,139,402 A * 10/2000 Moore ..... 451/41
6,196,899 B1 * 3/2001 Chopra et al. ..... 451/56
6,210,257 B1 * 4/2001 Carlson ..... 451/56
6,213,845 B1 * 4/2001 Elledge ..... 451/6
6,244,944 B1 * 6/2001 Elledge ..... 451/296
6,273,796 B1 * 8/2001 Moore ..... 451/56

* cited by examiner

METHOD FOR CONDITIONING POLISHING SURFACE

This is a divisional of U.S. patent application Ser. No. 09/336,759, filed Jun. 21, 1999 now U.S. Pat. No. 6,196,899, the entire disclosure of which is incorporated herein by reference.

BACKGROUND OF THE INVENTION

1. Field of the Invention

The present invention relates generally to a system for conditioning a polishing surface, such as the surface of a web-shaped polishing pad. The invention also relates to rollers and other devices for applying different conditioning treatments to different portions of a polishing surface. The term "polishing" is used broadly herein to include planarizing and other mechanical and chemical-mechanical procedures for producing smooth surfaces.

2. Discussion of the Related Art

Systems for polishing semiconductor wafers and the like are well known. In a conventional process, a surface of a semiconductor wafer is mechanically scoured by a conformable polishing pad. A chemical slurry may be used in conjunction with the polishing pad to provide a high material removal rate and/or improved surface planarization.

In a typical chemical-mechanical planarization ("CMP") process, relative movement between a semiconductor substrate and a wetted pad causes material to be chemically and physically polished from the substrate surface. Chemical-mechanical planarization is used to prepare wafers for integrated circuits, and to planarize substrates on which one or more layers have been deposited and etched.

Referring now to FIG. 1, it has been suggested to provide a polishing apparatus 20 with a continuous web-shaped polishing pad 22. The pad 22 may be formed of a non-abrasive polymeric material, such as woven polyurethane, or other suitable materials. The pad 22 is movably supported on a workstation table 24. Guide rollers 26, 28 stretch the pad 22 over the table 24 in the illustrated position.

In operation, a carrier 30 presses a work piece, such as a semiconductor substrate 32, against the pad surface 34. The carrier 30 also rotates the substrate 32 around first and second parallel axes. Abrasive particles and/or chemicals in a planarizing slurry (not illustrated) assist in the removal of material from the surface of the substrate 32. The slurry may be dispensed through suitable nozzles (not illustrated).

Over time, the surface 34 of the web-shaped pad 22 becomes "glazed." The glazed condition may be caused by spent slurry accumulating in the porous pad surface 34. In addition, the pressure applied by the carrier 30 tends to compress the pad 22. As the pad 22 becomes glazed, its coefficient of friction is reduced and becomes non-uniform, resulting in a lower material removal rate and/or poor quality control. Glazing of the pad surface 34 may increase the time required to polish each substrate 32. In addition, such glazing may make it difficult to obtain the desired substrate planarity.

For these and other reasons, the pad 22 may be provided on a supply roller 52. The supply roller 52 carries an unused or pre-operative portion of the pad 12. A motor (not shown in FIG. 1) advances the pad 22 intermittently in the direction of arrows 54, 56. Thus, clean pre-operative pad sections may be quickly substituted for used, glazed sections to provide a consistent pad surface (with a uniform coefficient of friction). In addition, the used, glazed sections may be conditioned at a point downstream from the work piece carrier 30. The conditioned portion may be returned to the work piece carrier 30. A downstream roller (not shown in FIG. 1) draws the glazed post-operative portion of the pad 22 away from the work piece carrier 30.

Although the polishing system 20 is an improvement over the prior art, there is still a need for an improved system for conditioning the pad 22 to increase its useful life and improve its performance. Moreover, there is a need in the art for an improved conditioning device for applying different conditioning treatments to different portions of a polishing pad. The need for an improved conditioning device is applicable to web-shaped and circular polishing pads.

Systems for conditioning polishing pads are described in U.S. Pat. No. 5,830,043 (Aaron et al.), U.S. Pat. No. 5,785,585 (Manfredi et al.), U.S. Pat. No. 5,779,526 (Gill), U.S. Pat. No. 5,775,983 (Shendon et al.), U.S. Pat. No. 5,655,951 (Meikle et al.), U.S. Pat. No. 5,611,943 (Cadien et al.), U.S. Pat. No. 5,664,987 (Renteln), U.S. Pat. No. 5,527,424 (Mullins), and U.S. Pat. No. 5,486,131 (Cesna et al.) and European Published Patent Application No. 770,455 (Ko et al.).

SUMMARY OF THE INVENTION

The disadvantages of the prior art are overcome to a great extent by providing a web-format polishing apparatus with a device for conditioning a web-shaped polishing pad. Thus, according to one aspect of the invention, a polishing machine is provided with a system for moving a web-shaped polishing pad to and fro in the longitudinal direction, and a downstream device for conditioning a used glazed portion of the pad. According to this aspect of the invention, after the glazed portion is conditioned, it can be returned to its polishing position to polish more substrates.

In an alternative embodiment of the invention, the polishing pad may remain stationary and the conditioning device may be moved over and/or on the pad to the desired position for conditioning.

The polishing apparatus may be, for example, a chemical-mechanical planarizing machine for processing semiconductor wafers.

The conditioning device is preferably arranged to apply different conditioning treatments to different portions of the glazed polishing pad. Thus, the conditioning device may have roller segments that rotate at different speeds. Alternatively, the conditioning device may have non-cylindrical rollers that provide different rotational speeds at the pad surface, or means for applying different pressures to different portions of the pad.

According to another aspect of the invention, a conditioning device may be moved laterally to provide uniform or blended conditioning despite non-uniformities (such as spaces between rollers) in the conditioning device. In an alternative embodiment of the invention, a conditioning device is located at an angle with respect to the pad to provide uniform or blended conditioning without lateral movement.

The conditioning device may also be moved longitudinally, if desired, to ensure the desired conditioning over the entire length of the glazed portion.

According to another aspect of the invention, the surface characteristics of a polished work piece are measured, and the conditioning device is then controlled or adjusted in accordance with the measured characteristics. Thus, the invention may be used to reduce the occurrence of so-called within-wafer-non-uniformities ("WIWNUs").

Conditioning devices constructed in accordance with the present invention may be used with web-shaped polishing pads and with rigid circular platen pads.

These and other features and advantages of the invention will become apparent from the following detailed description of preferred embodiments of the invention.

DETAILED DESCRIPTION OF PREFERRED EMBODIMENTS

Figure 1:
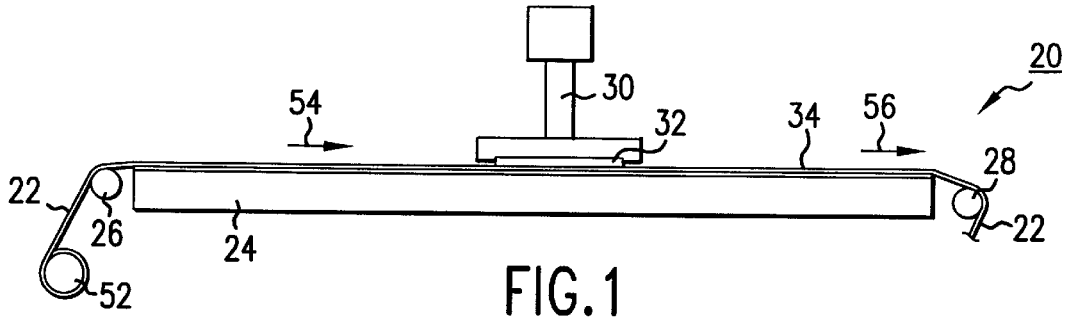
FIG. 1 is a side view of a web-format polishing apparatus for polishing semiconductor wafers.
Figure 2:
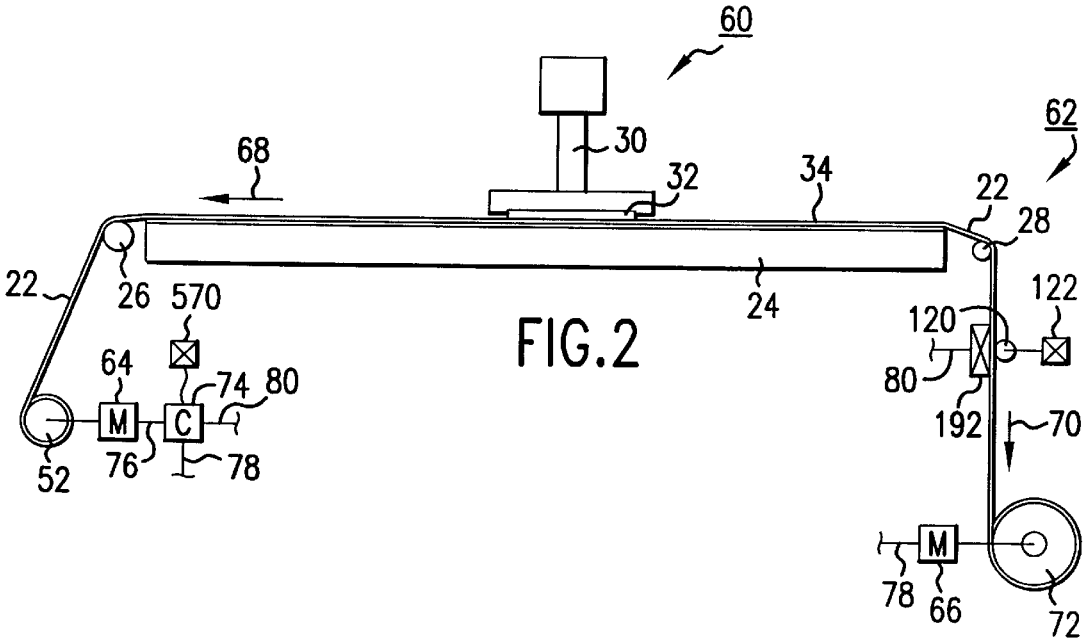
FIG. 2 is a side view of a web-format polishing apparatus constructed in accordance with a preferred embodiment of the present invention.

Referring now to the drawings, where like reference numerals designate like elements, there is shown in FIG. 2 a polishing apparatus 60 constructed in accordance with a preferred embodiment of the present invention. In addition to the components discussed above in connection with FIG. 1, the apparatus 60 has a conditioning device 62, and motors 64, 66 for moving the web-shaped pad 22 longitudinally back and forth in the directions indicated by arrows 68, 70.

The motors 64, 66 rotate the supply and take-up rollers 52, 72. The motors 64, 66 and the conditioning device 62 may be controlled by a suitable controller 74. The controller 74 may be connected to the motors 64, 66 and the conditioning device 62 by suitable signal lines 76, 78, 80. The motors 64, 66, the conditioning device 62, the controller 74, and the signal lines 76–80 are shown schematically in FIG. 2. The controller 74 may be, for example, a programmed general purpose microprocessor.

When the portion of the pad 22 located under the carrier 30 becomes glazed, the controller 74 indexes the take-up motor 66 to move the pad 22 a predetermined amount in the forward direction (70). This causes the glazed portion to be located in the conditioning device 62, and it brings a fresh pad portion under the carrier 30. Then, while the carrier 30 is polishing a substrate 32 on the fresh portion of the pad 22, the conditioning device 62 conditions the glazed pad portion. Then, after the substrate 32 is polished and removed from the carrier 30, the controller 74 indexes the pad 22 in the backward direction (68) to relocate the conditioned pad portion underneath the carrier 30. Then, a second substrate (not shown) is located in the carrier 30 and polished on the conditioned pad portion.

In an alternative embodiment of the invention, as the pad 22 becomes glazed, the pad 22 is indexed toward the conditioning device 62. As the pad (or web) 22 is moved, the conditioning device 62 starts operating and the relative motion (70) between the pad 22 and the conditioning device 62 results in conditioning of the pad 22. As soon as the pad 22 is conditioned, the conditioned portion of the pad 22 may be moved back (68) to the polishing position and a new polishing operation can begin.

The glazing/conditioning cycle may be repeated until the glazed/conditioned portion of the pad 22 becomes damaged or is otherwise no longer capable of being efficiently conditioned. At that point, the controller 74 indexes the pad portion past the conditioning device 62 and onto the take-up reel 72, causing another fresh portion of the pad 22 to be moved from the supply reel 52 to the carrier 30.

Figure 3:
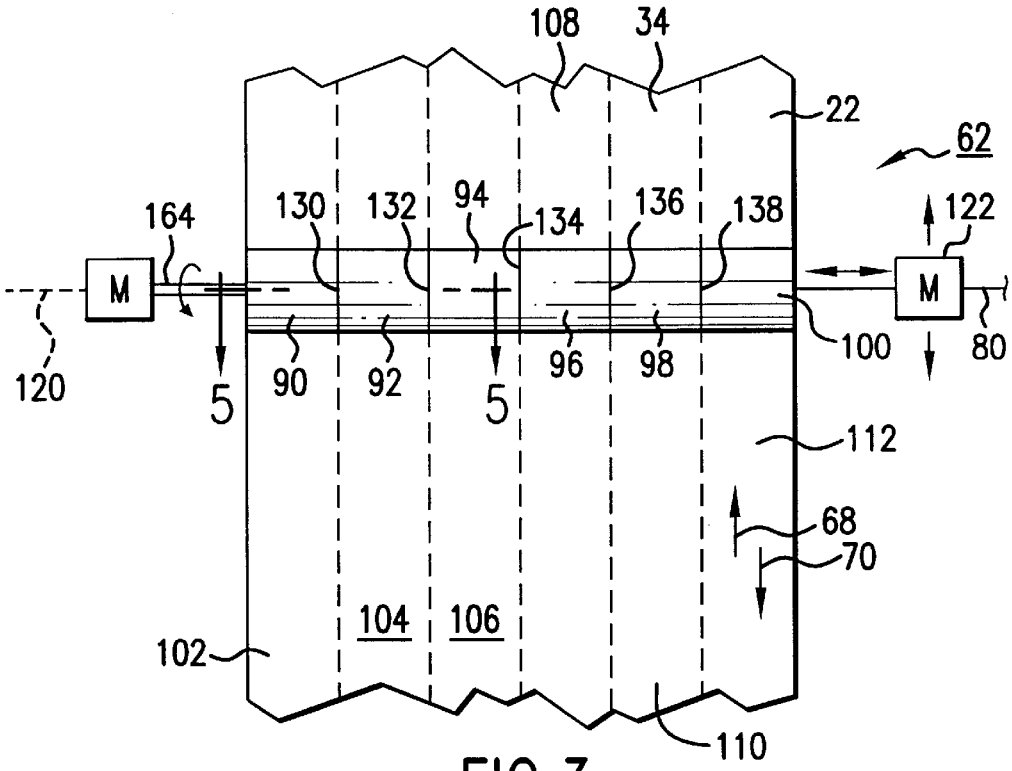
FIG. 3 is a top view of the conditioning device of FIG. 2.

Referring now to FIG. 3, the conditioning device 62 may have a plurality of coaxially aligned roller segments 90, 92, 94, 96, 98, 100. The cylindrical exterior surfaces of the roller segments 90–100 are scored, knurled or otherwise textured or roughened to condition the pad surface 34 as desired. For example, the exterior surfaces of the roller segments 90–100 may be provided with a diamond-impregnated carrier, brushes, or a silicon carbide material. The roller segments 90–100 are located over respective longitudinal surface portions 102, 104, 106, 108, 110, 112 of the web-shaped pad 22.

Although six roller segments 90–100 are shown in FIG. 3, more or less roller segments may be used to practice the invention. For example, where the web-shaped polishing pad is about twenty inches wide, the roller segments may each be about one inch wide, measured in the direction of the axis of rotation. There should preferably be at least three roller segments, and even more preferably five to twenty-five roller segments for each conditioning device.

The roller segments 90–100 may be rotated about a common axis 120 at different speeds to apply different conditioning treatments to the different pad portions 102–112. In the illustrated embodiment, the inner surface portions 106, 108 of the pad 22 tend to become more glazed than the outer surface portions 102, 112. Consequently, the inner roller segments 94, 96 are rotated more rapidly than the outer roller segments 90, 100. The rapid rotation of the inner roller segments 94, 96 provides greater conditioning for the more heavily glazed inner surface portions 106, 108. This way, the inner surface portions 106, 108 are adequately and efficiently conditioned without damaging or over conditioning the outer surface portions 102, 112.

A translational drive system 122 may be used to move the conditioning device 62 laterally to and fro (in the direction of the rotation axis 120) during the conditioning process. The drive system 122 provides for conditioning of the pad portions that would otherwise be located between the roller segments 90–100. There are small empty spaces 130, 132, 134, 136, 138 between the roller segments 90–100 to accommodate bearings, drive transmission elements, and the like.

The translational drive system 122 ensures that the empty spaces 130–138 of the conditioning device 62 do not remain in one place, but rather are distributed to and fro so that the pad 22 is uniformly conditioned over its entire surface 34. In addition, the to and fro motion generated by the drive system 122 blends together areas on the pad surface 34 which have rollers operating at different speeds and/or with different roller coverages. That is, the to and fro motion of the conditioning device 62 provides smooth transitions, in terms of the amount of surface conditioning, between the surface portions 102–112.

The translational drive system 122 may also be used to move the conditioning device 62 to and fro in the longitudinal direction (68, 70) during the conditioning process. This way, the pad surface 34 is uniformly conditioned along the entire length of the glazed portion. The translational drive system 122 is shown schematically in the drawings. The system 122 may be constructed, for example, of one or more electric motors and drive transmission systems.

Figure 4:
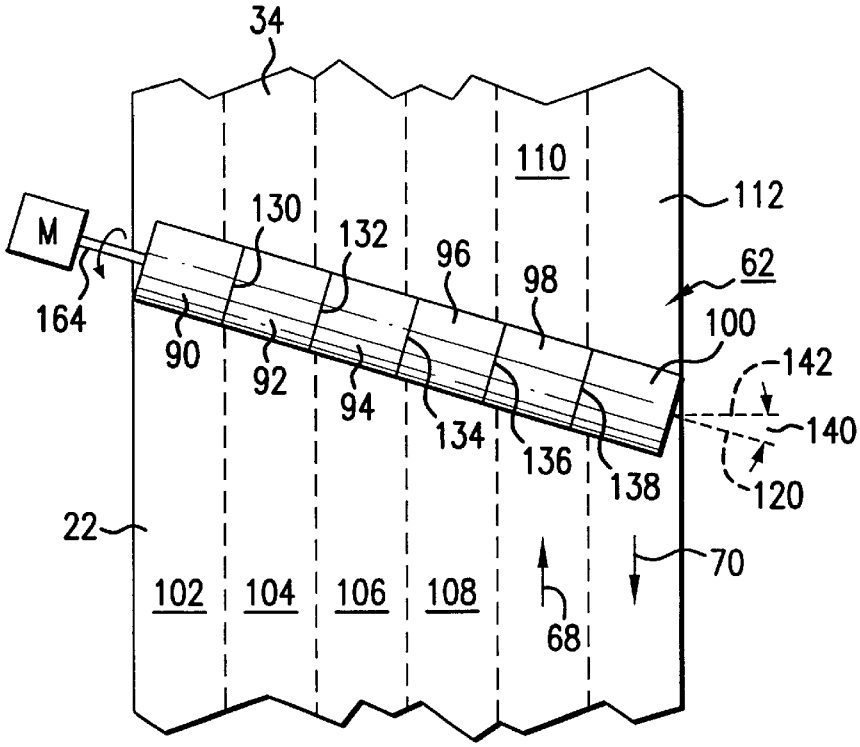
FIG. 4 is a top view of another conditioning device constructed in accordance with the present invention.

Referring now to FIG. 4, the axis of rotation 120 of the conditioning device 62 may be located at an angle 140 (greater than zero) with respect to the lateral direction 142 of the web-shaped pad 22. The angle 140 may be, for example, in the range of from fifteen degrees to fifty degrees. By providing the conditioning device 62 at an angle 140, as shown in FIG. 4, uniform conditioning may be achieved without lateral movement of the conditioning device 62.

The roller segments 90–100 may be selectively rotated by a wide variety of mechanical and electromechanical systems. In the arrangement shown in FIG. 5, the roller segments 90–94 are provided with epicyclic gear trains, with planetary gears 144, 146, 148 meshing with respective gear rings 150, 152, 154 and sun gears 156, 158, 160. The planetary gears 144–148 are rotatably mounted on a fixed shaft 162. The sun gears 156–160 are integrally connected to a common drive shaft 164. The drive shaft 164 is coincident with the axis of rotation 120. The planetary gears 144–148 have different diameters. Consequently, rotation of the drive shaft 164 causes the roller segments 90–94 to rotate at different speeds.

Figure 5:
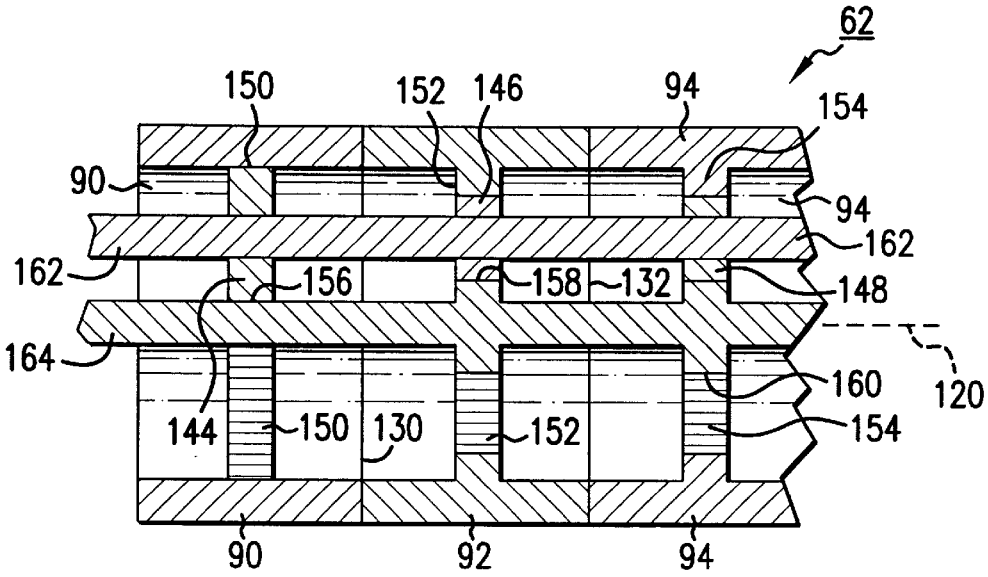
FIG. 5 is a cross sectional view of a portion of the conditioning device of FIG. 3, taken along the line 5—5.

Only three roller segments 90–94 and three epicyclic gear trains are shown in FIG. 5 for the sake of clarity of illustration. In practice, similar gear trains may be formed inside the other roller segments 96–100, and all of the roller segments 90–100 may be driven by the same drive shaft 164, if desired. Suitable bearings (not illustrated) may be provided for supporting the various components in the desired positions.

Figure 6:
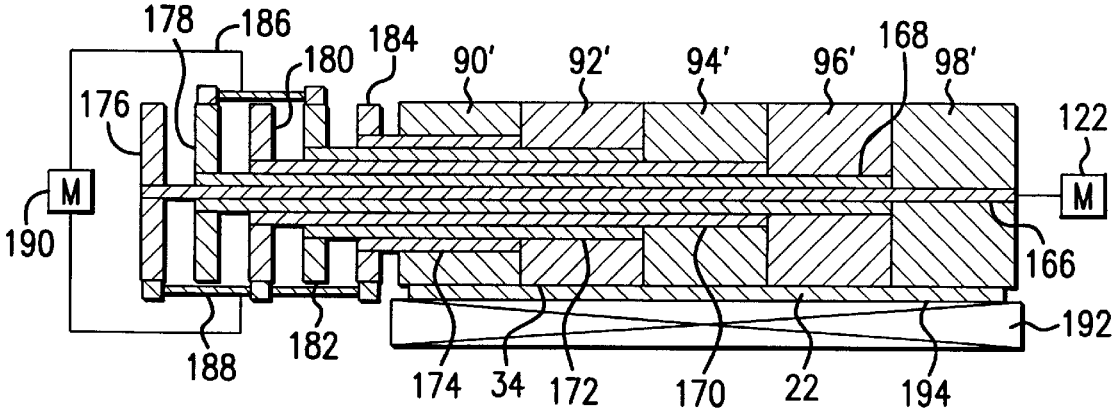
FIG. 6 is a cross sectional view of another conditioning device constructed in accordance with the present invention.

Another mechanism for rotating roller segments 90', 92', 94', 96', 98' at different speeds is shown in FIG. 6. In the illustrated embodiment, the roller segments 90'–98' are provided with coaxial shafts 166, 168, 170, 172, 174. The shafts 166–174 are integrally connected to gears 176, 178, 180, 182, 184. The gears 176–184 are located outside the roller segments 90'–98'. The gears 176–184 are meshed with a suitable drive gear system 186, 188. The drive gear system 186, 188 may be driven by a motor 190. In the illustrated embodiment, the rotational speeds of the roller segments 90'98' are determined by the dimensions of the gears 176–184. In an alternative embodiment of the invention, a separate drive mechanism may be provided for each outside gear 176–184 so that the speeds of the roller segments 90'–98' are individually controllable.

A fixed table 192 may be provided with a surface 194 for slidably supporting the back surface of the web-shaped pad 22.

Figure 7:
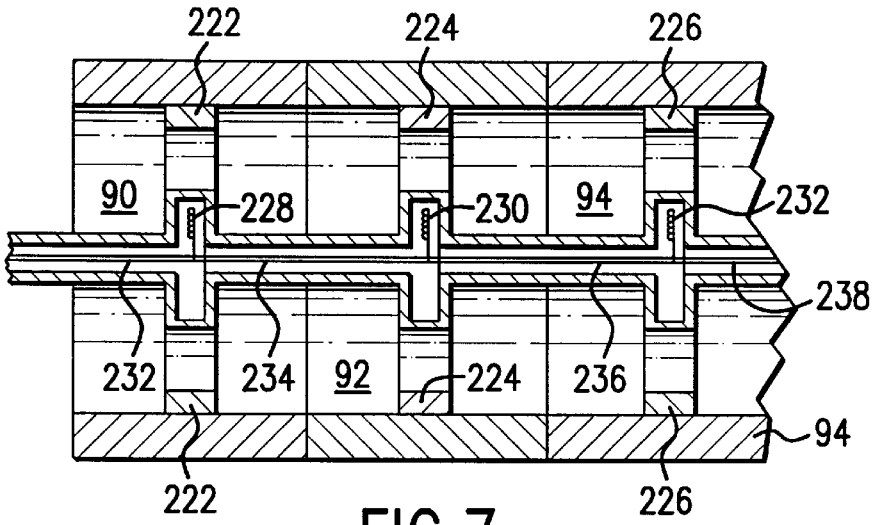
FIG. 7 is a cross sectional view of yet another conditioning device constructed in accordance with the present invention.

In yet another embodiment of the invention, as shown in FIG. 7, an electric brushless motor may be provided in each roller segment 90–100. Each motor may have its own induction core magnets 222, 224, 226 and multi-pole drive coils 228, 230, 231. The motors may be individually controlled via suitable wires 232, 234, 236, 238 to individually control and/or adjust the speeds of the respective roller segments 90–100.

Figure 8:
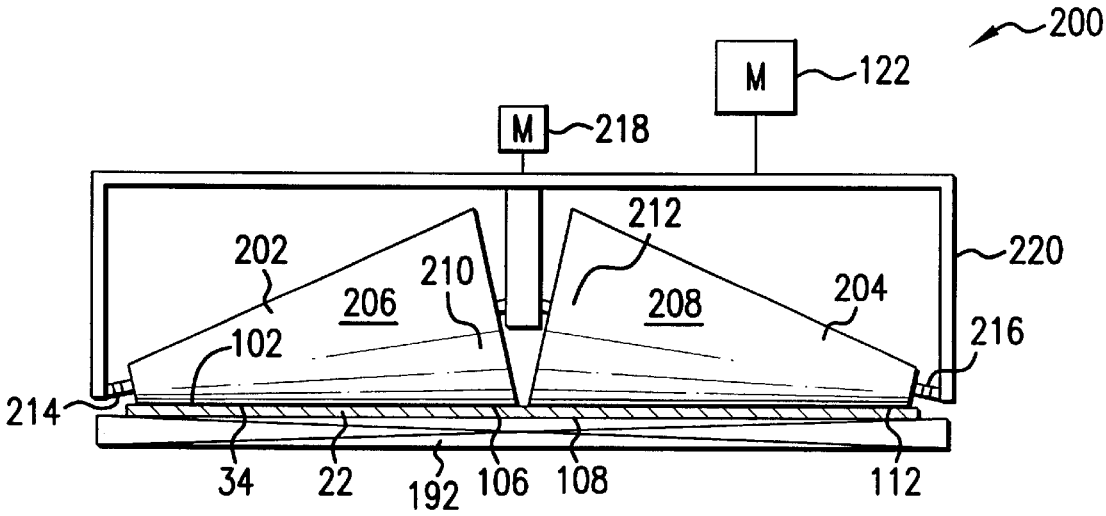
FIG. 8 is a front view of yet another conditioning device constructed in accordance with the present invention.

Referring now to FIG. 8, a conditioning device 200 is provided with first and second frustoconical rollers 202, 204. The frustoconical roller surfaces 206, 208 are scored, knurled or otherwise textured or roughened to condition the surface 34 of the pad 22. The wide portions 210, 212 of the rollers 202, 204 are located next to each other. The rollers 202, 204 are mounted on respective drive shafts 214, 216. The shafts 214, 216 are rotated by a suitable motor system 218 mounted on a frame 220.

In operation, the inner portions 106, 108 of the pad 22 are subjected to more intense conditioning since the rollers 202, 204 rotate faster at the surfaces of the wide ends 210, 212. The device 200 may be moved laterally by a suitable motorized device 122 to apply blended conditioning to the central portion of the pad 22, that would otherwise be located between the rollers 202, 204. The motorized device 122 may also be arranged to move the conditioning device 200 longitudinally to condition the entire length of the glazed portion of the pad 22.

In addition, the exterior surfaces of the roller segments 90–100 and non-cylindrical rollers 202, 204 may have different textures or roughnesses, if desired, in the lateral direction 142 of the pad 22. The different surface features of the conditioning device may be designed or selected to obtain the desired conditioning pattern on the pad 22.

Figure 9:
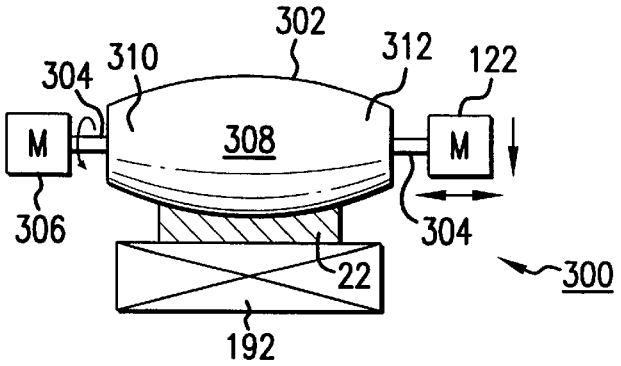
FIG. 9 is a front view of yet another conditioning device constructed in accordance with the present invention.

Referring now to FIG. 9, a conditioning device 300 is provided with a single roller 302 mounted on a drive shaft 304. The surface of the roller 302 is axially symmetric with respect to the shaft 304. A motor 306 is provided to rotate the roller 302. The roller surface is scored, knurled or otherwise textured or roughened to provide frictional or mechanical conditioning as in the embodiments discussed above. The drive shaft 304 may be mounted in a suitable support frame (not illustrated).

In the illustrated embodiment, the roller 302 is thicker in the middle 308 than it is at the ends 310, 312. Consequently, the device 300 applies more pressure to the pad 22 in the vicinity of the inner surface portions 106, 108 and less pressure at the edge portions 102, 112. The pad 22 is subjected to more intense conditioning at the regions 106, 108 where greater pressure is applied. In addition, the roller surface moves more rapidly at the middle 308 than at the ends 310, 312, which contributes to the differential conditioning effect.

If desired, the surface characteristics of the roller 302 may be varied in the lateral direction. For example, the surface at the middle 308 may be rougher or coarser than the surface at the ends 310, 312 to provide more intense conditioning underneath the middle portion of the roller 302.

As in the embodiments described above, the conditioning device 300 may be moved laterally and in the longitudinal direction to achieve the desired uniform conditioning along the entire length of the glazed pad portion. The lateral and longitudinal movement may be provided by a suitable motorized device 122, which may include one or more electrical motors and drive transmission systems.

Figure 10:
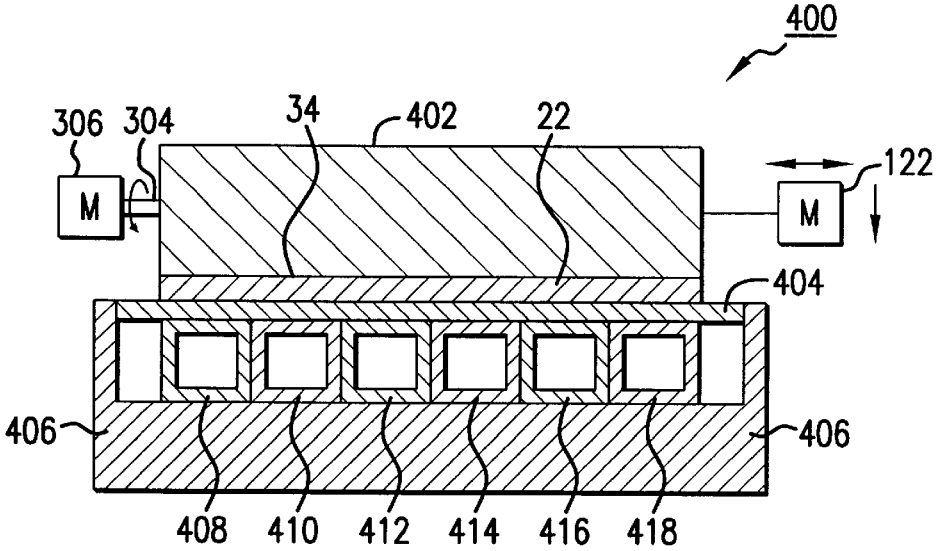
FIG. 10 is a cross sectional view of yet another conditioning device constructed in accordance with the present invention.

Referring now to FIG. 10, a conditioning device 400 has a cylindrical conditioning roller 402 located above the polishing pad 22 and a flexible low friction bearing material, such as a bearing plate 404, located beneath the pad 22. The pad 22 is sandwiched between the roller 402 and the flexible plate 404. The bearing plate 404 is supported by a suitable frame 406. The roller 402 is rotated by a suitable motor 306 and drive shaft 304. The flexible plate 404 slidably supports the back surface of the pad 22. Inflatable bladders 408, 410, 412, 414, 416, 418 are located within the frame 406 and beneath the flexible plate 404.

The bladders 408–418 may be selectively inflated to different pressures to create correspondingly different local pressures between the pad surface 34 and the roller 402. At those portions where the pad 22 is pressed more firmly against the roller 402, a more intense conditioning treatment is applied. At those portions where the pad 22 is located over relatively low pressure bladders, there is correspondingly less pressure between the pad 22 and the roller 402 and hence less intense conditioning treatments are applied at those locations. The bladders 408–418 may be connected to a suitable pneumatic control system (not shown) such that the pressures in the bladders 408–418 are individually controllable on a real time basis.

Figure 11:
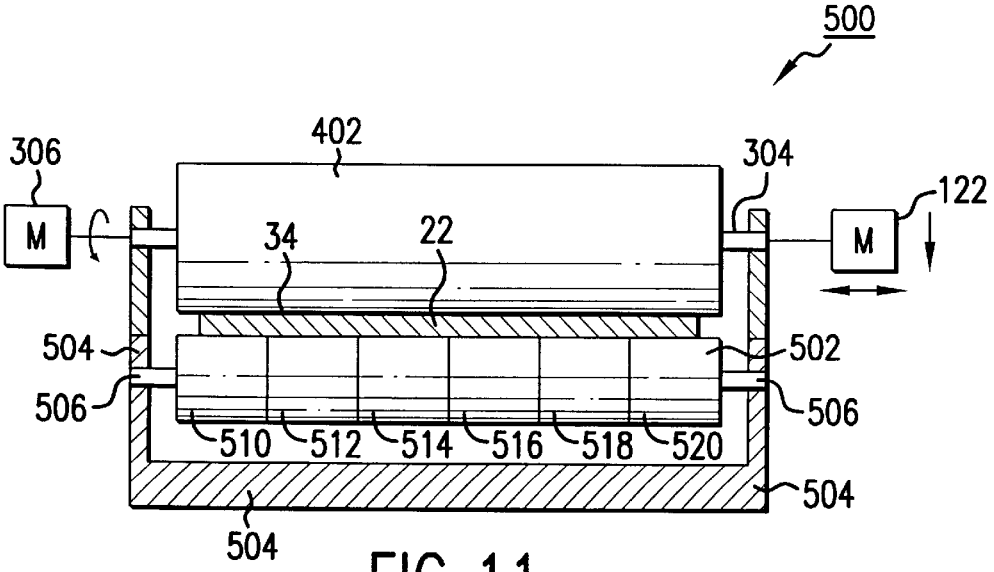
FIG. 11 is a front view of yet another conditioning device constructed in accordance with the present invention.

FIG. 11 shows another conditioning device 500 constructed in accordance with the present invention. The conditioning device 500 has a roller 402 that applies pressure to the surface 34 of a web-shaped pad 22. The roller 402 is rotated by a suitable motor 306 and drive shaft 304. The back surface of the pad 22 is supported by a rotatable support roller 502. The support roller 502 is rotatably supported with respect to a frame 504 by an axle 506. As the pad 22 moves longitudinally (68, 70, FIG. 2), the support roller 502 rolls underneath the pad 22.

The roller 502 may be provided with inflatable bladder portions 510, 512, 514, 516, 518, 520. The bladder portions 510–520 may be individually inflated to control the intensity of the conditioning applied to the different longitudinal portions 102–112 (FIG. 3) of the polishing surface 34. The pressures in the bladders 510–520 may be changed to account for changed conditions or to achieve a desired conditioning pattern.

Figure 12:
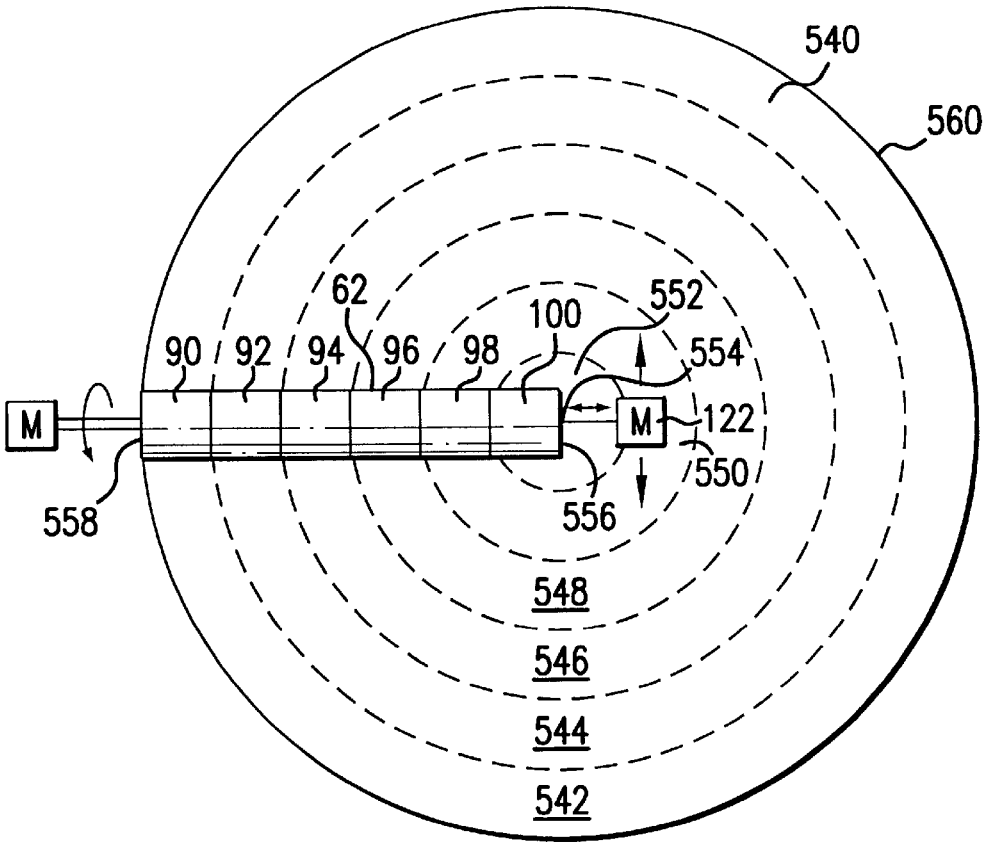
FIG. 12 is a top view of the conditioning device of FIG. 3, shown conditioning a circular polishing pad.

Each of the conditioning devices 62, 200, 300, 400, 500 may be used to condition circular polishing pads in addition to the illustrated web-shaped pad 22. By way of example, FIG. 12 shows a conditioning device 62 in position to condition a circular polishing pad 540. In the illustrated embodiment, the radius of the polishing pad 540 is approximately equal to the combined length of the aligned roller segments 90–100.

In alternative embodiments of the invention, the conditioning device 62 may be located other than to one side of the pad 540. The conditioning devices 200, 300 shown in FIGS. 8 and 9, for example, may be sized to fit across the full diameter of the pad 540. That is, the lengths of the rollers 202, 204, 302 shown in FIG. 2 may be greater than the radius of the pad 540.

In another alternative embodiment of the invention, the conditioning device 62 may be positioned at an angle with respect to the radius of the pad 540. That is, the conditioning device 62 may be positioned so that the axis of rotation for the rollers 90–100 does not cross over the center of rotation for the pad 540. Providing an angled position for the conditioning device 62 in this manner may facilitate blending of the conditioning treatment between the rollers 90–100.

In operation, the roller segments 90–100 are rotated at different speeds to provide different conditioning treatments to concentric portions 542, 544, 546, 548, 550, 552 of the pad 540. The pad 540 may be rotated about its center 554 to ensure that the whole surface 542–552 is conditioned. Alternatively, the pad 540 may be held stationary and the conditioning device 62 may be rotated about its inner end 556. That is, the inner end 556 may be maintained at the center 554 of the pad 540 while the outer end 558 is moved by the translational drive means 122 along the entire periphery 560 of the pad 540.

In addition, the translational drive means 122 may move the conditioning device 62 to and fro radially with respect to the pad center 554. This to and fro movement ensures that regions between the concentric portions 542–552 are conditioned even though there are spaces between the roller segments 90–100. In addition, the to and fro radial movement blends the conditioning effect between adjacent surface portions 542–552 so there are no sharp discontinuities in conditioning treatment between the adjacent surface portions 542–552.

The polishing apparatuses 62, 200, 300, 400, 500 described herein may be used together with a device 570 (FIG. 3) for measuring the planarity of finished wafers 32. The measuring device 570 may be, for example, a multipoint film measurement tool of the type marketed by NovaScan. Data from the measuring device may be processed by a general purpose microprocessor 74 and the results may be used to modify and/or control the conditioning treatments applied to different portions 102–112, 542–552 of the pad 22, 540.

Thus, for example, uniformity data may be used to determine the individual speeds of the roller segments 90–100 (or the pressures applied to the respective longitudinal portions 102–112 of the pad surface 34). Data may also be obtained, if desired, based on measurements of the profile and/or the wear experienced by the pad/web 22, 540. The data may also be used to determine the amount or frequency of the translational movement (122) or the extent to which the conditioning device 62, 200, 300, 400, 500 is moved longitudinally with respect to the pad 22, 540.

Figure 13:
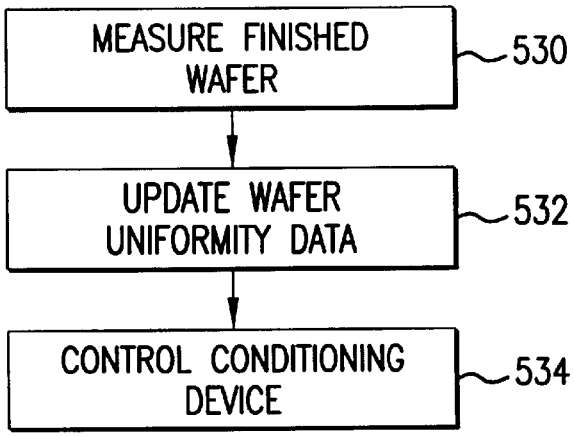
FIG. 13 illustrates a method of operating a polishing apparatus according to a preferred embodiment of the present invention.

Referring to FIG. 13, topographic data from selected points on a finished wafer 32 may be collected by the measuring device (Step 530). The data may be processed and used to update wafer uniformity data stored in a memory 74 (Step 532). The stored uniformity data may be used to selectively update, adjust and/or control the conditioning device 62, 200, 300, 400, 500 (Step 534).

The above descriptions and drawings are only illustrative of preferred embodiments which achieve the features and advantages of the present invention, and it is not intended that the present invention be limited thereto. Any modification of the present invention which comes within the spirit and scope of the following claims is considered part of the present invention.

What is claimed as new and desired to be protected by Letters Patent of the United States is:

1. A method of polishing semiconductor work pieces, said method comprising the steps of:

applying slurry to a web-shaped polishing pad;

pressing a first semiconductor work piece against said web-shaped polishing pad, and moving said work piece with respect to said pad;

providing a conditioning surface;

providing relative movement in a first direction between said web-shaped polishing pad and said conditioning device;

using said conditioning device to condition a glazed portion of said web-shaped polishing pad, and wherein said step of using said conditioning device includes the steps of applying different conditioning treatments to different portions of said glazed portion of said web-shaped polishing pad;

subsequently, providing relative movement in a second direction between said web-shaped polishing pad and said conditioning device; and pressing a second semiconductor work piece against said web-shaped polishing pad, and moving said second semiconductor work piece with respect to said pad.

2. The polishing method of claim 1, wherein said step of providing relative movement in said first direction includes the step of unwinding said pad from a supply roller.

3. The polishing method of claim 1, wherein said step of providing relative movement in said first direction includes the steps of maintaining said pad in a stationary position and moving said conditioning device over said pad.

4. The polishing method of claim 1, wherein said step of moving said first semiconductor work piece includes the step of simultaneously rotating said first semiconductor work piece about parallel axes.

5. The polishing method of claim 1, wherein said step of applying slurry includes the step of applying slurry to a polishing pad that includes polyurethane.

6. The polishing method of claim 1, further comprising the step of measuring surface characteristics of said first semiconductor work piece.

7. The polishing method of claim 6, further comprising the steps of measuring the surface characteristics of said second semiconductor work piece and subsequently conditioning said pad.

* * * * *